US005259082A

United States Patent [19]

Sebor

[11] Patent Number: 5,259,082

[45] Date of Patent: Nov. 9, 1993

[54] MECHANISM FOR DISLODGING A SUBMERSIBLE CLEANING DEVICE FROM A SURFACE

[76] Inventor: Pavel Sebor, 45 Highcliff Way, Northcliff Extension 12, Johannesburg, Transvall, South Africa

[21] Appl. No.: 880,668

[22] Filed: May 11, 1992

[30] Foreign Application Priority Data

Feb. 28, 1992 [ZA] South Africa ..... 92/1507

[51] Int. Cl.[5] ..... E04H 4/16

[52] U.S. Cl. ..... 15/1.7

[58] Field of Search ..... 15/1.7

[56] References Cited

U.S. PATENT DOCUMENTS

| | | | |
|---|---|---|---|
| 3,430,277 | 3/1969 | Ortega | 15/1.7 |
| 3,803,658 | 4/1974 | Raubenheimer | 15/1.7 |
| 4,023,227 | 5/1977 | Chauvier | 15/1.7 |
| 4,133,068 | 1/1979 | Hofmann | 15/1.7 |
| 4,193,156 | 3/1980 | Chauvier | 15/1.7 |
| 4,761,848 | 8/1988 | Hofmann | 15/1.7 |

FOREIGN PATENT DOCUMENTS

| | | | |
|---|---|---|---|
| 3320922 | 10/1983 | Fed. Rep. of Germany | 15/1.7 |
| 2520421 | 7/1983 | France | 15/1.7 |

*Primary Examiner*—Harvey C. Hornsby
*Assistant Examiner*—Mark Spisich
*Attorney, Agent, or Firm*—Allen, Dyer, Doppelt, Franjola & Milbrath

[57] ABSTRACT

A mechanism is provided for dislodging a submersible cleaning device from a vertical wall after a predetermined time period on such wall. The mechanism includes an operating gear that engages when the cleaning device climbs the wall. Once engaged, the gear drives a cam mechanism which in turn engages a device for pushing the cleaner off the wall thereby breaking the suction of the cleaning device and causing the cleaning device to drop from the wall. A turning brush is used to break the suction but it will be appreciated that any lever or similar device can be employed.

2 Claims, 2 Drawing Sheets

MECHANISM FOR DISLODGING A SUBMERSIBLE CLEANING DEVICE FROM A SURFACE

BACKGROUND OF THE INVENTION

This invention relates to a kick-off for a submersible cleaning device.

SUMMARY OF THE INVENTION

It is an object of the present invention to provide a mechanism whereby a submersible cleaning device will be dislodged from a generally vertical wall a predetermined period after mounting such wall.

According to the invention such a mechanism comprises a rotatably mounted operating member having an eccentric centre of gravity, the operating member defining an arc of gear teeth concentric with the axis of rotation of the member, and a driven gear wheel mounted adjacent the operating member, the arrangement being one wherein in a first attitude of the cleaning device, the gear wheel is out of engagement with the arc of gear teeth of the operating member, and in a second attitude of the cleaning device gravity causes the operating member to rotate as a result of its eccentric centre of gravity, so that the gear wheel drivingly engages the arc of gear teeth on the operating member whereby the latter causes the cleaning device to perform a predetermined manoeuvre. Thus for example, in one arrangement when the pool cleaner moves on a generally horizontal surface, the gear wheel will remain out of engagement with the arc of teeth on the operating device, but when the cleaner mounts a generally vertical surface, the operating member will rotate so that the gear wheel drivingly engages the arc of teeth.

Further according to the invention the arc of the teeth and gear wheel will be selected so that the manoeuvre of the cleaning device is performed after a predetermined time delay.

The invention envisages that the operating member could cause the cleaning device to perform any required manoeuvre. For example the operating member could include a lever adapted to kick the cleaning device away from the vertical surface or alternatively, cause the cleaning device to be dislodged from the wall surface by bringing a turning brush into operation such that suction of the cleaning device is broken.

Also included within the scope of this invention is a method of causing a submersible cleaning device to perform a predetermined manoeuvre during a change of attitude of the cleaning device substantially as herein disclosed.

In order to illustrate the invention an embodiment thereof is described hereunder by way of example with reference to the accompanying drawings wherein:

BRIEF DESCRIPTION OF DRAWINGS

FIG. 1A is a schematic exploded perspective view of the steering mechanism for a submersible cleaning device;

DETAILED DESCRIPTION OF PREFERRED EMBODIMENT

Figure 1:
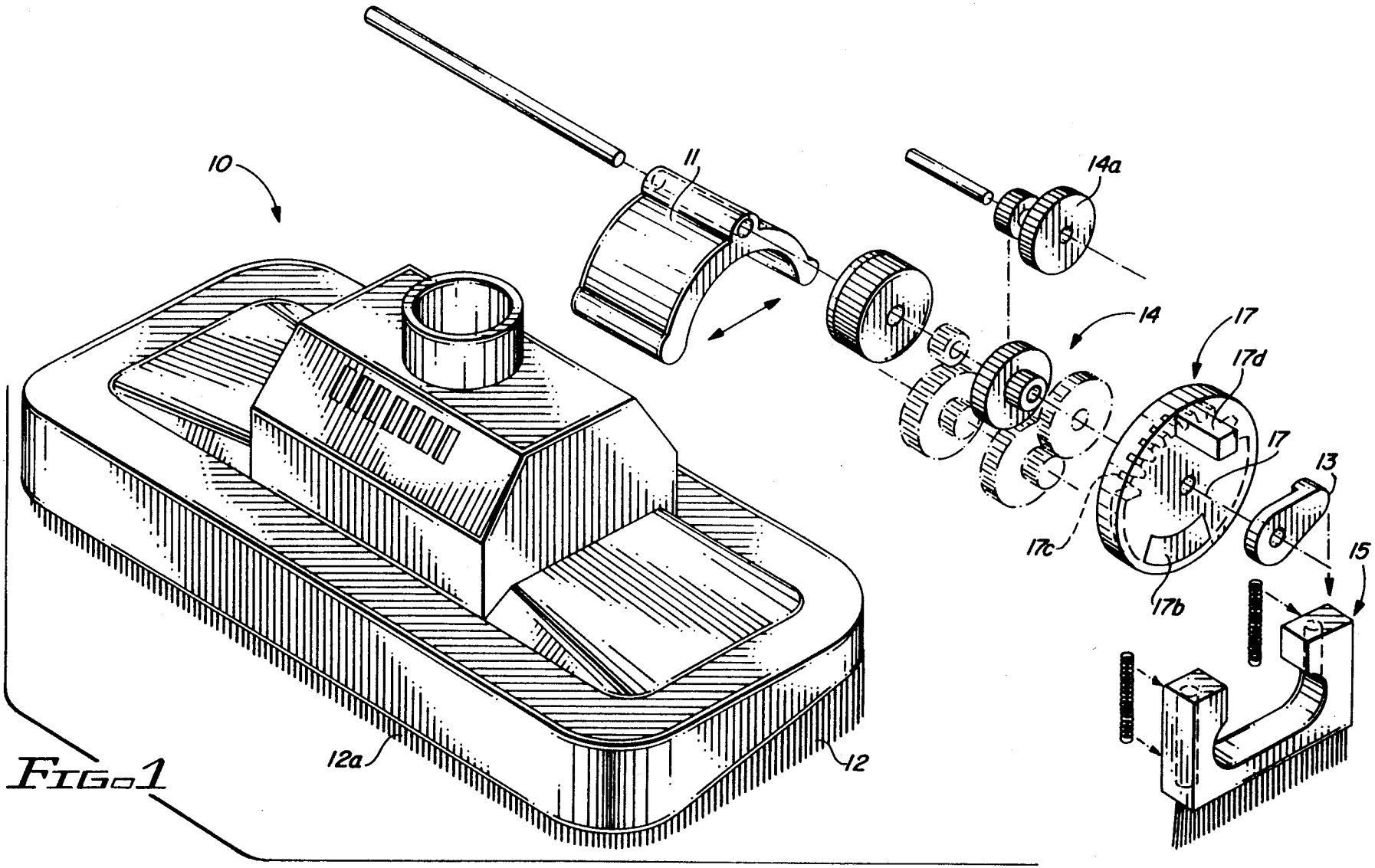
FIG. 1 is a perspective view of a submersible cleaning device of the suction type used with the preferred embodiment of the invention.
Figure 2:
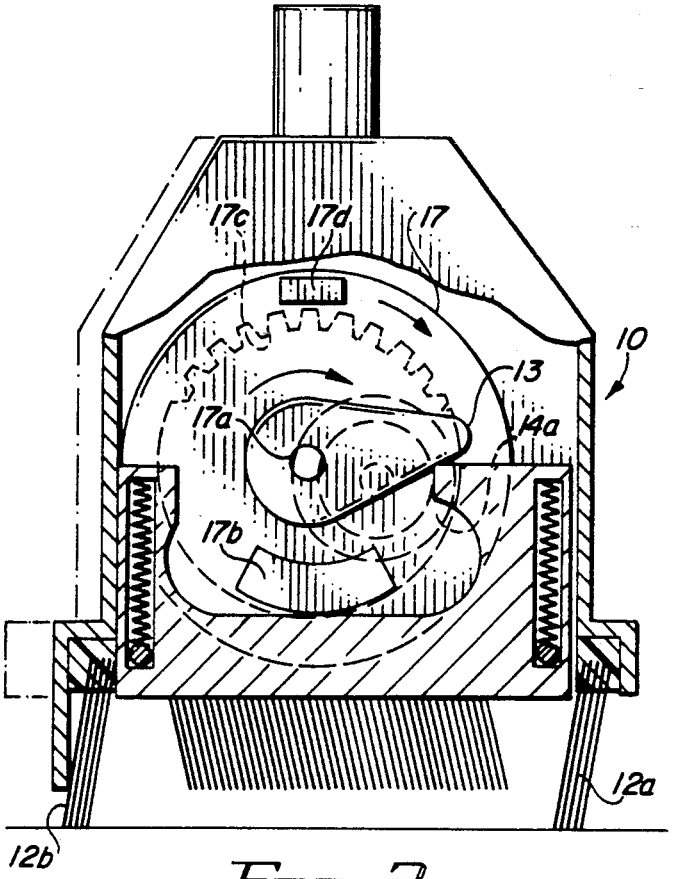
FIG. 2 is a schematic sectioned elevation of the steering device in FIG. 1.
Figure 4:
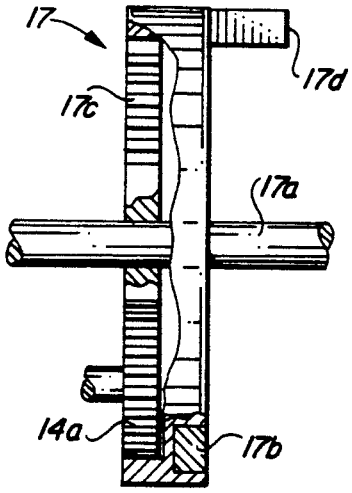
FIG. 4 is an elevation of the device shown in FIG. 3.
Figure 3:
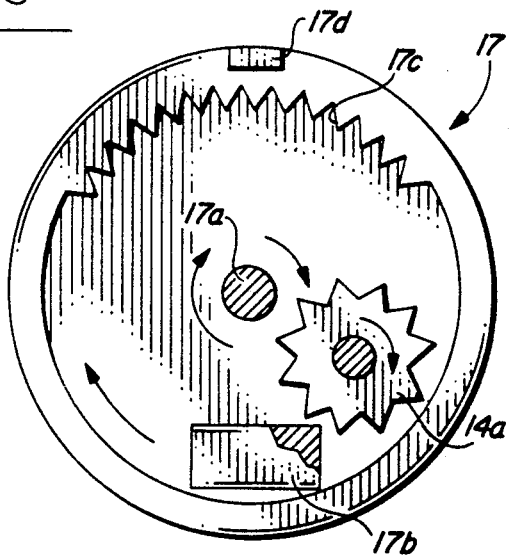
FIG. 3 is a schematic illustration of the principle of operation of the steering device in FIG. 1.
Figure 5:
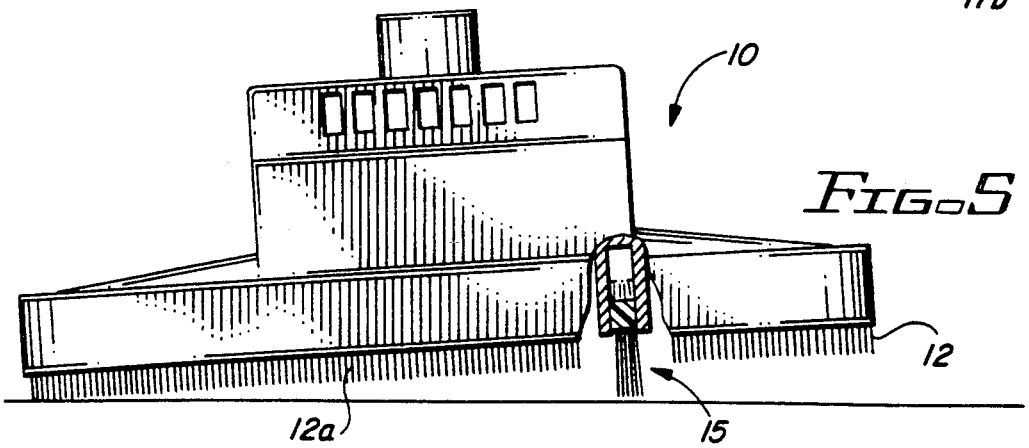
FIG. 5 is a schematic elevation of the principle of steering applied in the device in FIG. 1.

Referring to the drawings a steering mechanism for a submersible cleaner 10 is illustrated. The cleaner 10 is of the type wherein an oscillator 11 as a result of liquid flow, imparts to and fro impulses to the cleaning device 10, and the action of front and rear bristle curtains 12*a* and 12*b* which are angled rearwardly has the effect of causing the cleaner 10 to move in a forwardly direction. The oscillator 11 also drives an arm member 13, FIG. 1A, through a reduction gear arrangement 14 so that the arm member 13 periodically lifts a transverse steering brush 15 which causes the cleaner to perform a turning manoeuvre. The bristles of the steering brush being angled in a direction opposite to those of the bristle curtains 12*a* and 12*b*, as illustrated in FIG. 2.

The present invention provides an operating mechanism which is adapted to be driven by the oscillator 11 through one of the gears 14*a* to cause the cleaning device to perform a predetermined manoeuvre. In the arrangement illustrated, such a manoeuvre will be to dislodge the cleaning device from a vertical wall surface resulting from the lifting by the mechanism of the turning brush 15 thus breaking the suction effect of the cleaning device. The mechanism comprises an operating member 17 in the form of a disc which is rotatable about an axis 17*a* and which has an eccentric centre of gravity as a result of a weight 17*b* which is secured eccentrically to the disc towards its periphery. The operating member 17 further includes an internal arc of gear teeth 17*c* which are engageable by the gear wheel 14*a* as described in more detail below.

The operating member 17 is arranged such that when the cleaning device 10 is in a horizontal attitude, i.e. on a generally horizontal surface, the arc of gear teeth 17*c* will be out of engagement with the gear wheel 14*a*. However, when the cleaning device 10 assumes a vertical attitude as it mounts a generally vertical wall surface, the eccentric weight 17*b* under the influence of gravity, will cause relative rotation of the operating mechanism 17 causing the gear wheel 14*a* to engage the arc of gear teeth 17*c* and to drive such teeth, thereby drivingly rotating the operating mechanism 17.

Such driven rotation of the operating mechanism 17 will be utilised to cause a cam formation 17*d* on the operating member 17 to engage the turning brush 15 to push such brush into engagement with the submerged surface and thus break the suction of the cleaning device and cause it to drop off the vertical wall. It will be appreciated that the operating member 17 could be utilised to perform other functions for example such as a manoeuvre whereby the cleaning device 10 is forced away from the submerged surface by means of a lever, (not shown), extending from the operating member 17. By a suitable selection of the gear teeth 17*c* and gear wheel 14*a* the operating mechanism will come into operation only after a predetermined time interval. In this way the cleaning device will remain on a vertical wall for a predetermined period before being dislodged therefrom. The operating member 17 can thus be adapted to ensure that the cleaning device will not break the surface of the liquid in which it operates.

Doubtless other variations of the invention also exist in detail without departing from the principles set out in the consistory clauses.

What is claimed is:

1. A mechanism for dislodging a submersible cleaning device of the suction type relying on the to and fro motion of an oscillator and angled bristled in contact with a submerged surface for forward movement over the submerged surface, the dislodging mechanism forming an operative part of the cleaning device the mechanism comprising:

a driven shaft operatively connected to the oscillator;

an arm member affixed to the shaft, for rotating about the axis of the shaft;

a steering brush having bristles angled for driving the cleaning device in a rearward movement when in contact with the submerged surface, the steering brush is adapted to be moved to a first position out of contact with the surface and forced into a second extended position in contact with the surface by engagement with the arm member, the contact with the surface causing the cleaning device to be rotated as a result of the to and fro oscillator motion;

an operating member rotatably mounted onto the shaft so as to rotate about an axis, the operating member having an eccentric center of gravity, the operating member having an arc of gear teeth affixed thereto, the arc concentric with the axis of rotation of the operating member;

a driven gear wheel mounted adjacent the operating member wherein for a first substantially horizontal attitude of the cleaning device the gear wheel is out of engagement with the arc of gear teeth and in a second substantially vertical attitude of the cleaning device, gravity causes the operating member to rotate as a result of its eccentric center of gravity so that the gear wheel drivingly engages the arc of gear teeth of the operating member; and a cam member affixed to the operating member for engaging the steering brush during rotation of the operating member, the engagement of the steering brush causing the brush to extend outwardly against the surface and lift the cleaning device so as to break the suction of the device holding it against the surface.

2. The mechanism as recited in claim 1, wherein the cam member engages a lever, the lever movably positioned to lift the cleaning device extending the lever outside the cleaning device during engagement with the cam member so as to cause the cleaning device to break suction with the surface.

* * * * *

UNITED STATES PATENT AND TRADEMARK OFFICE
Certificate

Patent No. 5,259,082 Patented: November 9, 1993

On petition requesting issuance of a certificate for correction of inventorship pursuant to 35 U.S.C. 256, it has been found that the above identified patent, through error and without any deceptive intent, improperly sets forth the inventorship.

Accordingly, it is hereby certified that the correct inventorship of this patent is: Pavel Sebor, Johannesburg, Transvall, South Africa; and Dieter J. Rief, Santa Rosa, CA.

Signed and Sealed this Thirteenth Day of September 2005.

JILL WARDEN
*Supervisory Patent Examiner*
Art Unit 1743